United States Patent [19]

Maddock

[11] Patent Number: 4,953,701

[45] Date of Patent: Sep. 4, 1990

[54] FLUORESCENT TUBE CARRIER

[76] Inventor: Paul T. Maddock, 943 Raymo Rd., Windsor, Ontario, Canada, N8Y 4A7

[21] Appl. No.: 394,532

[22] Filed: Aug. 16, 1989

[51] Int. Cl.[5] ..... B65D 85/42

[52] U.S. Cl. ..... 206/419; 241/99; 241/168

[58] Field of Search ..... 206/418, 419; 241/36, 241/99, 100, 168

[56] References Cited

U.S. PATENT DOCUMENTS

| | | | |
|---|---|---|---|
| 2,167,040 | 7/1939 | Farner et al. | 241/99 X |
| 2,178,797 | 11/1939 | La Vigne | 241/99 |
| 2,230,019 | 1/1941 | Tucke | 241/99 |
| 2,638,022 | 5/1953 | Reyes | 241/99 X |
| 2,659,253 | 11/1953 | Myrick | 241/99 |
| 4,579,287 | 4/1986 | Brown | 241/36 |
| 4,662,535 | 5/1987 | Loveland | 206/419 X |

FOREIGN PATENT DOCUMENTS

| | | | |
|---|---|---|---|
| 2120500 | 2/1973 | Fed. Rep. of Germany | 241/99 |
| 2532703 | 2/1977 | Fed. Rep. of Germany | 241/99 |
| 22812 | of 1904 | United Kingdom | 241/99 |
| 13720 | of 1913 | United Kingdom | 241/99 |

OTHER PUBLICATIONS

Food Industries, vol. 21, Issue No. 11, p. 108, Nov. 1949.

*Primary Examiner*—Bryon P. Gehman
*Attorney, Agent, or Firm*—Daryl W. Schnurr

[57] ABSTRACT

A fluorescent tube carrier for transporting and/or assisting in the disposal of flourescent tubes has four capsules, one for each tube. The capsules are held in a generally square cross-sectional configuration by spacers and have removable covers at either end. The covers have an interior surface that is cushioned to protect new flourescent tubes located within the capsules from shock. There are a series of tiny openings along the side of each capsule, the openings being large enough to receive a pin. When spent tubes are contained within the capsules, a pin can be inserted into the tiny openings to break the tubes. In a second disposal step, there is a rod, which is stored on the carrier, that can be inserted into each capsule to force the broken glass towards an area of the carrier where it can be disposed of. Spent fluorescent tubes have a potential of exploding at any time and therefore pose a danger during disposal. The carrier eliminates this danger during the first stage of disposal.

11 Claims, 4 Drawing Sheets

FLUORESCENT TUBE CARRIER

BACKGROUND OF THE INVENTION

1. Field of the Invention

This invention relates to a fluorescent tube carrier for transporting and/or assisting in the disposal of fluorescent tubes. More particularly, this invention relates to a fluorescent tube carrier for carrying a plurality of fluorescent tubes and/or disposing of spent tubes by breaking them in a safe manner within the carrier.

2. Description of the Prior Art

Previously, when installing fluorescent tubes, an installer would usually carry one or two replacement tubes by hand. The installer would then remove the spent tubes from a fixture and replace them with the new tubes, all the time being very careful not to accidentally break the tubes and not to get the new tubes confused with the spent tubes. Sometimes, an installer would carry a cardboard container of new tubes along with him. The spent tubes are then placed in the same container as the replacement tubes are removed. This can be very confusing to an installer as to which tubes are new and which tubes are spent. It can also be very cumbersome, particularly if the installer wishes to carry any other object in addition to the carton of tubes. Both procedures can be dangerous, particularly when an installer is carrying the tubes through a workplace as the tubes will easily break if they come into contact with a hard object such as a corner of a desk or a machine. When fluorescent tubes break, they can explode and can cause injury to the installer or any surrounding persons. Further, difficulties are encountered when the spent fluorescent tubes are disposed of as these too can easily break as they are transported from an area of the light fixture to a disposal area. Also, the spent tubes occupy an unnecessarily large space when they are disposed of in unbroken form and they remain potentially dangerous as they can explode at any time.

SUMMARY OF THE INVENTION

It is an object of the present invention to provide a fluorescent tube carrier that is safe and efficient in both transporting new tubes from storage to a light fixture and in transporting and disposing of spent tubes.

For use with a plurality of fluorescent tubes, a carrier for transporting or disposing of said tubes has a plurality of capsules, one for each tube desired to be carried. Each capsule has two ends, at least one end being at least partially closed by a cover. The cover of said at least one end of each capsule is removable so that said end can be opened. There are means on the carrier for breaking independently, if desired, the tube located in any particular capsule breaking, if desired, the tubes in other capsules. All of said capsules are held in a fixed relationship to one another by a plurality of spacers located along the length of the capsules. Each spacer has openings for each of the capsules. The carrier has a rod that is long enough to force pieces of a broken fluorescent tube to an area of the carrier where the pieces can be disposed of. Each spacer has an additional opening that provides a location for storing said rod on said carrier.

DESCRIPTION OF A PREFERRED EMBODIMENT

Figure 1:
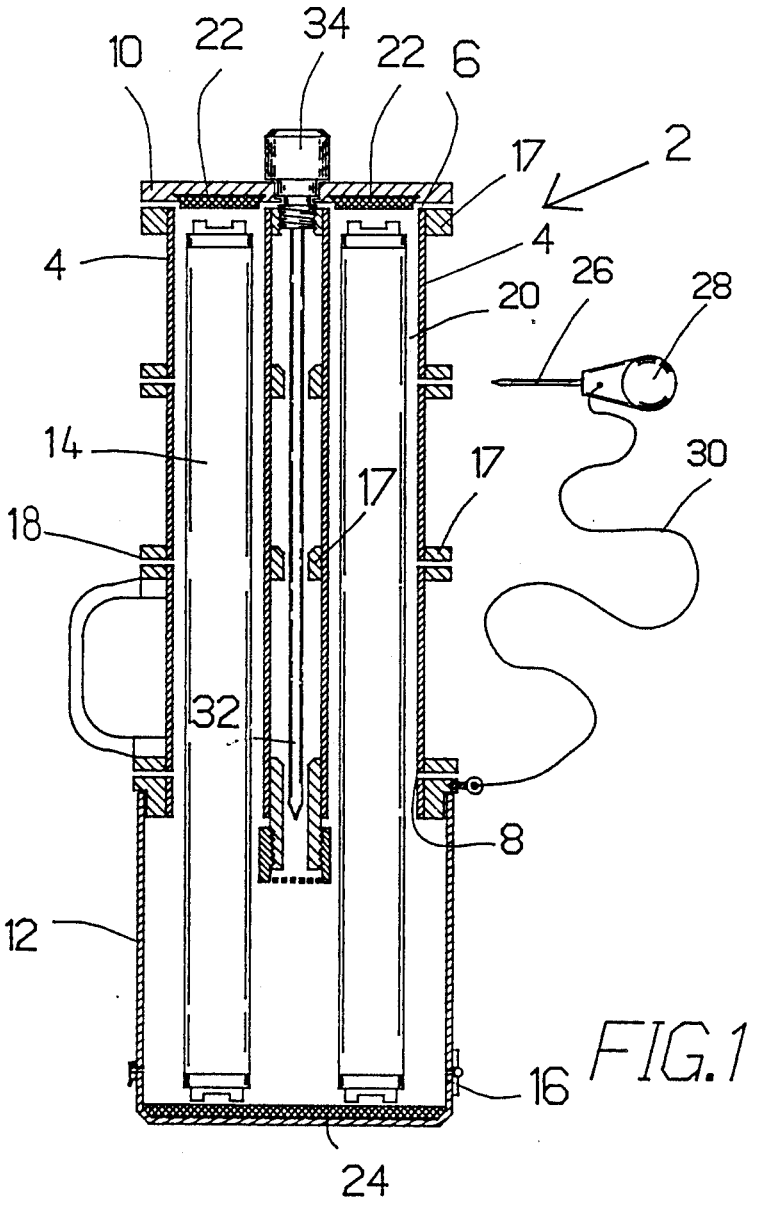
FIG. 1 is a sectional side view of one embodiment of a fluorescent tube carrier.

Referring to FIG. 1 in greater detail, it can be seen that a fluorescent tube carrier 2 has a plurality of capsules 4 (only two of which are shown in FIG. 1). Each capsule has two ends 6, 8. The end 6 of each capsule 4 is closed off by a removable cover 10. At the other end 8 of each capsule 4, there is located a container 12. The container 12 is large enough to completely cover all of the ends 8 of the capsules 4 and deep enough to accommodate that part of a fluorescent tube 14 that extends beyond the ends 8 of each of the capsules 4. The container 12 is removably affixed to the ends 8 of the capsules 4 in any conventional manner. The container 12 has a base 16 that is removable from the rest of the container. Four spacers 17 hold the capsules in a fixed relationship with one another. The particular spacer 17 located at an end 8 of the capsules 4 also serves as a cover to prevent any broken glass within the container 12 from leaving the container 2.

Each capsule has a number of tiny openings 18 located along an outer side thereof. Each opening 18 provides a passageway to an interior 20 of a capsule in which the opening is located. Cushions 22, 24 are located on an interior surface of the cover 10 and the base 16 to cushion any shocks to the fluorescent tubes 14 that are carried within the carrier 2.

When a new tube 14 has been replaced in the capsule with a spent tube 14, the carrier 2 can be used to dispose of the spent tube. In the embodiment of the invention shown in FIG. 1, a pin 26 having a handle 28 is connected to the carrier 2 by a flexible cable 30. The cable 30 can be of any suitable material of sufficient strength. When it is desired to break a spent tube 14 located within one of the capsules 4, the pin 26 can be manually successively inserted into the three openings 18 shown on each capsule 4 shown in FIG. 1.

Figure 2:
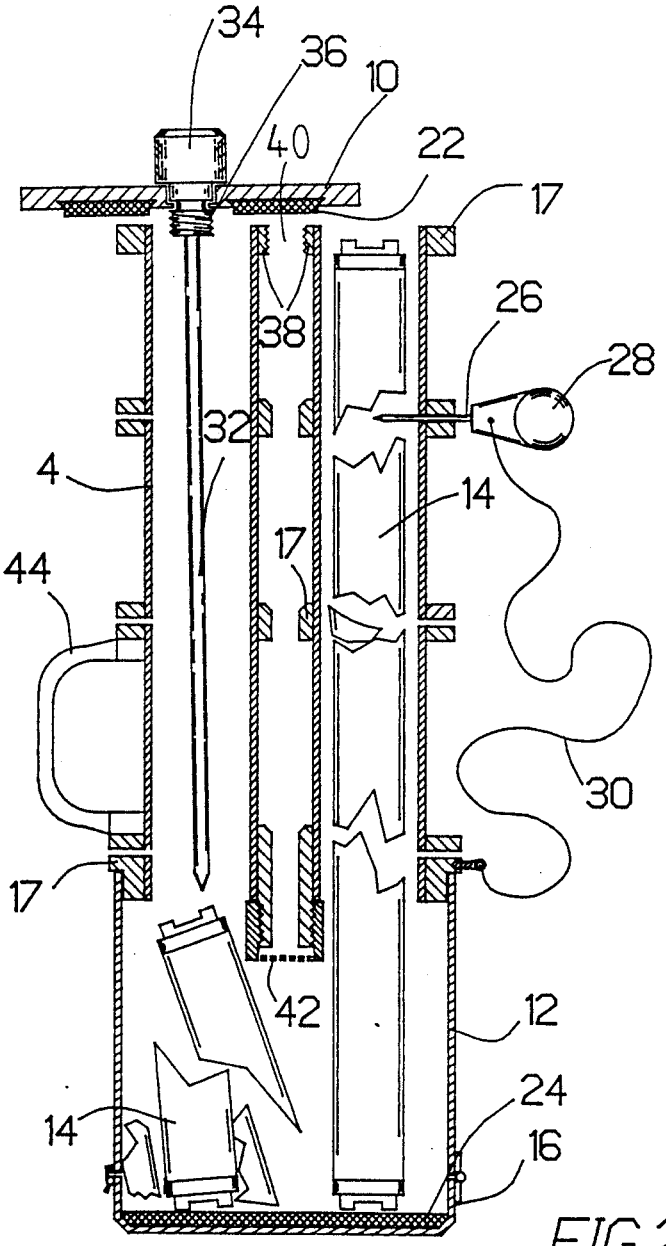
FIG. 2 is a sectional side view of the fluorescent tube carrier of FIG. 1 showing the fluorescent tubes being broken.

From FIG. 2, it can be seen that when the pin 26 is forcefully inserted into one of the openings 18, the pin will cause the tube within that particular capsule to break in the area of that opening. When the pin is inserted into all three openings of the same capsule, the fluorescent tube will be broken in at least three places. Attached to the cover 10 is a rod 32 having a handle 34. That part of the handle 34 immediately adjacent to the rod 32 has a screw thread 36 located thereon. The screw thread 36 corresponds to a screw thread 38 located within the central opening 40 of that spacer 17 that is located adjacent to the cover 10. As a variation, the screw thread 38 could be embedded into a side wall of each of the capsules by making the screw thread 36 slightly larger in diameter. When the screw thread 36 is interlocked with the screw thread 38, the cover 10 is held firmly on the end 6 of the carrier 2 as shown in FIG. 1. When the handle 34 is turned in an approxiate direction to disconnect the screw thread 36 from the screw thread 38, the cover 10, rod 32 and handle 34 are completely detached from the carrier 2. The rod 32 can then be inserted into a capsule 4, after the pin 26 has been used to break the tube in that capsule into smaller pieces, to further crush the tube and push it out of the capsule entirely and into the container 12 for subsequent disposal. This procedure is followed for all of the spent tubes in the carrier 2 by breaking the tubes firstly with the small pin 26 and then using the rod 32 to break them further and remove them entirely from the capsules 4. The container 12 can be detached from the ends 8 of the capsule and the contents of the container 12 can be dumped into a suitable waste disposal area. Alternatively, the cover 26 can be opened to empty the contents of the container 12 for disposal. A filter 42 permits the passage of air but not glass. It has been found that when the tubes are broken by the pin 26, any rush of air caused by the breaking of the tubes rushes through the filter 42, which covers the opening 40 located in the centre of that particular spacer 17 located at the end 8 of the capsules 4, rather than out the openings 18 and virtually no glass whatsoever leaves the carrier through the openings 18.

After the container 12 has been emptied of the broken tubes, the container is then replaced on the carrier as shown in FIG. 1, the cover 10 is removed and new tubes can be inserted into each of the capsules 4. The cover 10 is then replaced and the carrier is transported to a light fixture or fixtures that require one or more fluorescent tubes to be replaced. The carrier is preferably carried in a horizontal position through the use of the handle 44 mounted centrally between two capsules on one side of the carrier 2. Preferably, the carrier 2 has four capsules arranged in a square cross-sectional configuration.

Figure 3:
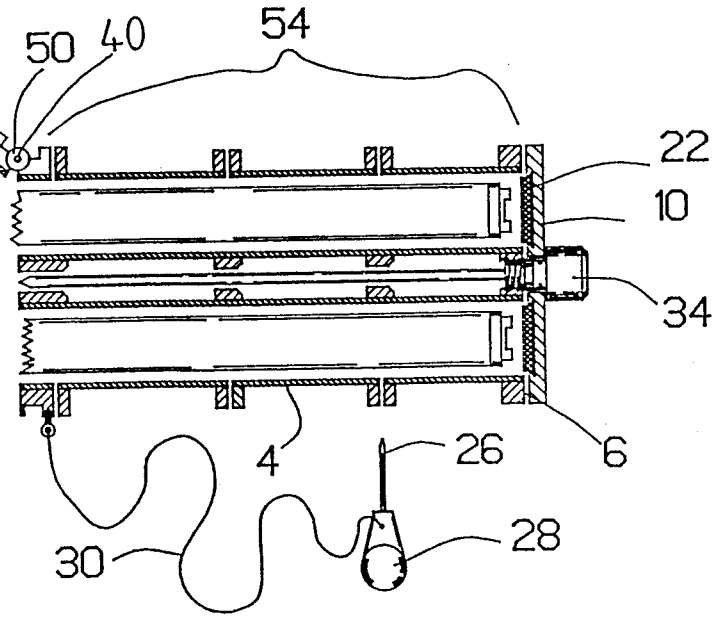
FIG. 3 is a sectional side view of another embodiment of a fluorescent tube carrier.
Figure 3:
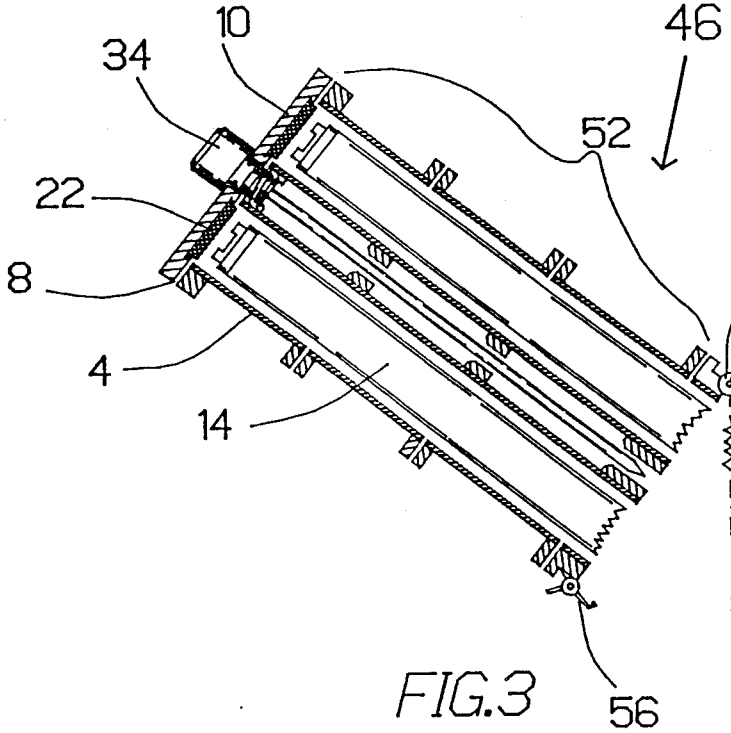

In FIG. 3, there is shown a carrier 46 that represents a further embodiment of the invention. As can be seen from FIG. 3, the carrier 46 has no container corresponding to the container 12 of the carrier 2. The capsules 4 of the carrier extend the full length of the carrier 46 between the two end covers 10. The covers 10 are identical to the cover 10 of the carrier 2 shown in FIGS. 1 and 2. The same reference numerals have been used for those components of FIG. 3 that are the same as the components of the carrier 2 shown in FIGS. 1 and 2. Each capsule 4 of the carrier 46 has a total of six openings 18. Also, there are two rods 32 and corresponding handles 34, one for each longitudinal half of the carrier 46. The carrier 46 is hinged at a centre point 48 by a hinge 50. While the fluorescent tubes 14 are shown as being broken at their centre, that break line is shown for ease of illustration only. When the carrier 46 is in a closed position so that the hinge 50 is closed and the two half sections 52, 54 are held together and the hinge 50 is prevented from opening by a locking device 56. One of the covers 10 is then removed and the new tubes 14 are inserted, one tube for each of the capsules 4. When the new tubes 14 have been replaced by spent tubes, the spent tubes can be broken by utilizing the pin 26 in the various openings 18. When the pin 26 has been inserted into the openings 18 for each capsule 4, the rod 32 and cover 10 can be removed from one end 6 of the capsules 4 and the broken tubes in the section 54 can be pushed towards a centre point 48 of the carrier 46. The cover 10 can then be replaced on the end 6 to the position shown in FIG. 3. Next, the other cover 10 can be removed from the end 8 and the broken tubes within the capsules 4 in the section 52 can be pushed towards the centre point 48. When that procedure has been completed, the cover 10 can be replaced on the end 8. Next, the locking device 56 can be detached so that the hinge 50 can be opened as shown in FIG. 3 to allow all of the broken tubes to be removed from the capsules 4 and disposed of in a suitable disposal area.

In a further embodiment of the invention, not shown in the drawings, the carrier could be designed in a similar manner to the carrier 46 without the hinge 50 and the locking device 56 so that the capsules 4 would be all one piece. In other words, the carrier would not open at its centre. When new tubes are inserted into the carrier, one of the covers 10 would simply be removed from either end 6, 8. The tubes would be broken for disposal purposes and either pushed towards a centre or pushed towards one end of the carrier. This could be accomplished by having one rod 32 extending along the full length of the carrier rather than having two rods that extend approximately halfway as does the carrier 46. After the tubes are suitably broken, a cover at one end could be removed and the carrier upended so that the broken tubes will fall out of each capsule into a suitable disposal area.

Figure 4:
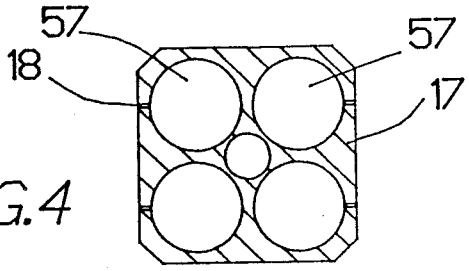
FIG. 4 is an end view of the carrier with the cover removed.

In FIG. 4, there is shown a sectional view of one of the spacers 17. It can be seen that the spacer contains four tiny openings 18, the centre opening 40 and four openings 57, one for each of the capsules 4 (not shown in FIG. 4).

Figure 5:
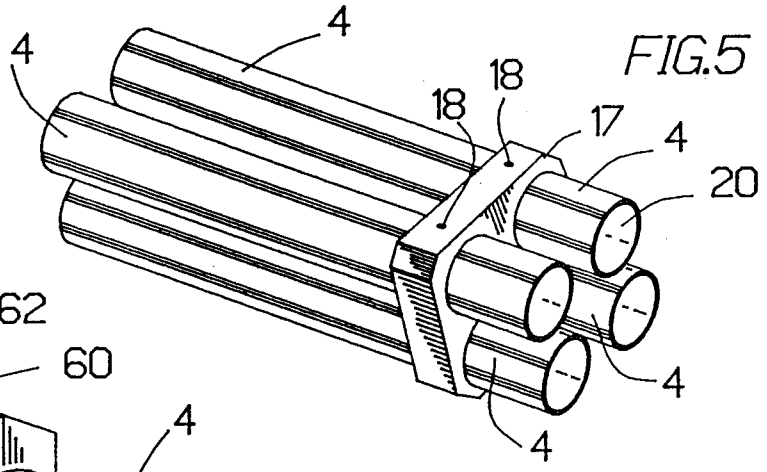
FIG. 5 is a partial perspective view of capsules of a carrier.
Figure 6:
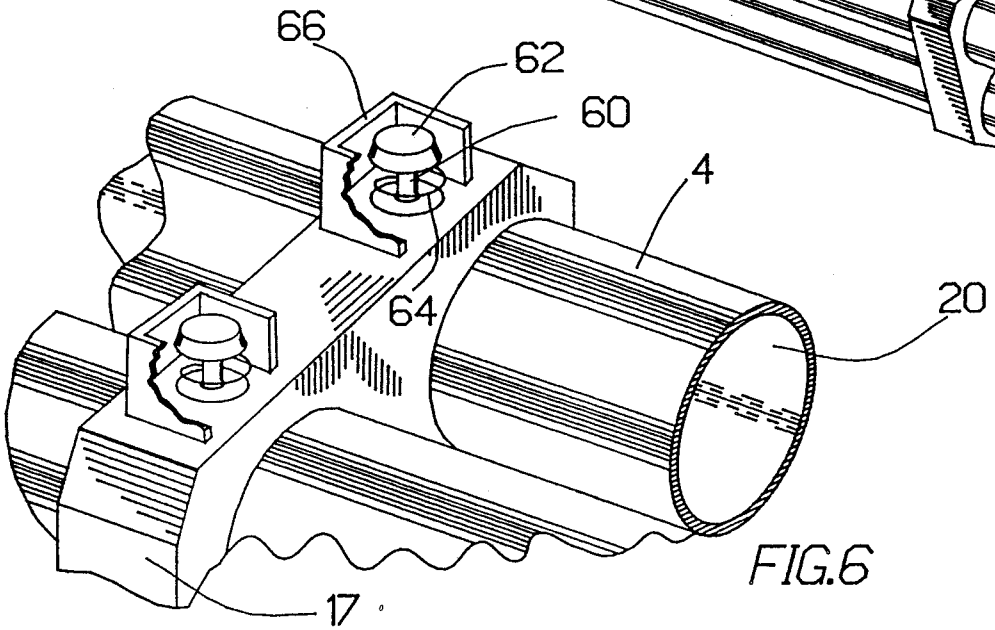
FIG. 6 is a partial perspective view of a carrier having spring-mounted pins to break the tubes located within the capsules.

In FIGS. 5 and 6, there is shown a further embodiment of the invention where the pin 26, handle 28 and cable 30 are replaced by a system that has a pin permanently spring-mounted at each opening 18. The capsules 4 are held in place by a collar 58 containing openings 18 that provide a passageway to an interior 20 of each capsule. Within each opening 18, there is mounted a pin 60 having a head 62. A spring 64 forces the pin 60 outward relative to the capsule when the pin is in a relaxed position. When the head 62 and pin 60 are forced inward, the pin 60 will penetrate a fluorescent tube contained within the capsule and break the tube in the same manner as the pin 26 shown in FIGS. 1, 2 and 3. When the pin 60 is released, the spring 64 will return the pin to the relaxed position shown in FIG. 6. A three-sided shield 66 protects the pin 60 from extraneous external forces so that the pin will not be pushed inward accidentally. The embodiment of the invention shown in FIGS. 5 and 6, has an advantage over other embodiments that utilize the pin 26 in that the tubes located within the capsules can be broken much more quickly. Also, any glass within the capsules is prevented from falling out of the openings 18 as the pins 60 always partially fill that opening. The system shown in FIG. 6 does not replace the central rod 32 but is intended to be used in conjunction therewith. If the openings 18 were located longitudinally closely adjacent to one another, the rods 32 could be eliminated as the tubes could be broken into very small pieces using only the pins 26 or 60.

Numerous variations can be made to the invention within the scope of the attached claims. For example, the number of capsules could be changed to any suitable number that can be conveniently carried. Further, each capsule could have signalling means thereon to indicate whether the capsule contains a new fluorescent tube or a spent tube. It may be desirable to include a chemical in the filter or elsewhere in the carrier for neutralizing any poisonous gases from the tubes. This signalling means could be a small plastic switch that shows green for new tubes and red for spent tubes. The signalling means is not essential as a user of the carrier could easily keep track of the tubes that are new and those that are spent by replacing the new tubes with spent tubes in the same order each time. Preferably, the carrier is designed in an appropriate length to transport a specific size of flourescent tube, for example, a four foot length. A second carrier could be designed to transport tubes of eight foot length.

What I claim as my invention is:

1. For use with a plurality of fluorescent tubes, a carrier for transporting or disposing of said tubes, said carrier comprising a plurality of capsules, one for each tube desired to be carried, each capsule having two ends, at least one end of each capsule being at least partially closed by a cover, the cover of said at least one end of each capsule being removable so that said end can be opened, with means on said carrier for breaking independently, if desired, the tube located in any particular capsule while not breaking, if desired, the tubes in other capsules, all of said capsules being held in a fixed relationship to one another by a plurality of spacers located along the length of the capsules, each spacer having openings for each of the capsules, said carrier having a rod that is long enough to force pieces of a broken fluorescent tube to an area of the carrier where the pieces can be disposed of, each spacer having an additional opening that provides a location for storing said rod on the carrier.

2. A carrier as claimed in claim 1 wherein the additional opening in each spacer is centrally located, said additional opening being surrounded by openings for each of the capsules.

3. A carrier as claimed in claim 2 wherein there is one cover at one end of the capsules and a container located at the other end of the capsules, each capsule terminating at said container, the capsule and container being sized so that when a tube is located within a capsule, the tube extends beyond an end of the capsule and into the container.

4. A carrier as claimed in claim 2 wherein there are four capsules, the capsules being located in a generally square cross-sectional configuration.

5. A carrier as claimed in claim 2 wherein the rod is stored along a longitudinal centre line of the carrier, said carrier having one cover for all of the capsules, the rod having a handle that is connected to said cover of the carrier, the cover being removable from the carrier by removing said rod.

6. A carrier as claimed in claim 5 wherein the handle of the rod is connected to said carrier by corresponding screw threads, one screw thread being located on said handle and another screw thread being located on said carrier.

7. A carrier as claimed in claim 2 wherein the capsules extend from end to end of said carrier and each end has a removable cover.

8. A carrier as claimed in any one of claims 1 or 2 wherein there is one cover at one end of the capsules and a container located at the other end of the capsules, each capsule terminating at said container, the capsule and container being sized so that when a tube is located within the capsule, the tube extends beyond an end of the capsule and into the container, the central opening of a spacer located at an end of the capsules where the container is removably attached is covered with a filter that allows the passage of air but not the passage of glass, the filter providing a circuitous route for air generated by the breaking of a tube to escape from the carrier.

9. A carrier as claimed in any one of claims 1 or 2 wherein the tiny openings for breaking the tubes extend through a side of the capsules and through said spacers.

10. A carrier as claimed in claim 9 wherein there is a pin surrounded by a spring located partially within each tiny opening on each of the spacers, the pins being spring-mounted and being long enough and containing a head so that when any pin is depressed, they will protrude into the tiny opening and break any tube located within the capsule, the pins returning to a rest position when an external force is removed by the action of a spring.

11. A carrier as claimed in claim 10 wherein there are means for protecting the spring-mounted pins from being accidentally activated.

* * * * *